US005327869A

United States Patent [19]

Rembold et al.

[11] Patent Number: 5,327,869

[45] Date of Patent: Jul. 12, 1994

[54] FUEL INJECTION DEVICE FOR SPARK-IGNITION INTERNAL COMBUSTION ENGINES

[75] Inventors: Helmut Rembold, Stuttgart; Ernst Linder, Mühlacker, both of Fed. Rep. of Germany

[73] Assignee: Robert Bosch GmbH, Stuttgart, Fed. Rep. of Germany

[21] Appl. No.: 838,817

[22] PCT Filed: Jun. 26, 1991

[86] PCT No.: PCT/DE91/00518

§ 371 Date: Mar. 20, 1992

§ 102(e) Date: Mar. 20, 1992

[87] PCT Pub. No.: WO92/01863

PCT Pub. Date: Feb. 6, 1992

[30] Foreign Application Priority Data

Jul. 21, 1990 [DE] Fed. Rep. of Germany ..... 4023307

[51] Int. Cl.[5] ..... F02M 37/04

[52] U.S. Cl. ..... 123/502; 123/450

[58] Field of Search ..... 123/450, 500, 501, 502, 123/449

[56] References Cited

U.S. PATENT DOCUMENTS

| | | | |
|---|---|---|---|
| 4,052,971 | 10/1977 | Salzgeber | 123/502 |
| 4,407,250 | 10/1983 | Eheim | 123/502 |
| 4,667,641 | 5/1987 | Djordjevic | 123/502 |
| 4,754,738 | 7/1988 | Grohn | 123/502 |

FOREIGN PATENT DOCUMENTS

| | | | |
|---|---|---|---|
| 0114991 | 8/1984 | European Pat. Off. . | |
| 933182 | 9/1955 | Fed. Rep. of Germany . | |
| 2626370 | 12/1976 | Fed. Rep. of Germany | 123/502 |
| 2508107 | 12/1982 | France . | |

*Primary Examiner*—Carl S. Miller
*Attorney, Agent, or Firm*—Michael J. Striker

[57] ABSTRACT

Fuel injection device for spark-ignition internal combustion engines having a pump and a distributor with a reversing valve, which distributor is preferably driven at pump speed and has a stationary and a rotating part. The reversing valve is arranged inside the rotating part of the distributor, preferably concentrically, and its inlet opening is connected with the pump work space via a line which likewise extends exclusively inside the rotating part of the distributor.

42 Claims, 4 Drawing Sheets

FUEL INJECTION DEVICE FOR SPARK-IGNITION INTERNAL COMBUSTION ENGINES

BACKGROUND OF THE INVENTION

The present invention relates to a fuel injection device for spark-ignition internal combustion engines.

More particularly, it relates to such a fuel injection device which has a pump and a distributor driven at a pump speed wherein a rotating part of the distributor alternatingly connects a feed line connected with the pump with injection lines leading to individual cylinders of the internal combustion engine as a function of the angle of rotation.

In a fuel injection device known from EP-PS 0 114 991 for spark-ignition internal combustion engines of this type the dwell time of the fuel in the combustion chamber during full-load operation of the internal combustion engine is lengthened compared to the dwell time during partial load operation by the 180° angle of rotation of a camshaft connected with a combustion engine piston. The amount of fuel injected is adapted to the load operation. For this purpose, the fuel injection device has a pump and a distributor which is preferably driven at pump speed. The rotating part of the distributor alternately connects a feed line, which is connected with the pump, with injection lines leading to the individual cylinders of the internal combustion engine via inner through-ducts as a function of the angle of rotation.

During full-load operation of the internal combustion engine the fuel is introduced into the combustion chamber during the suction stroke of the combustion engine piston so that this fuel can be thoroughly mixed to the time of ignition. In this way a complete combustion of the fuel-air mixture is ensured and soot emissions are prevented. On the other hand, during partial load operation of the internal combustion engine the fuel is injected very late, i.e. immediately before the time of ignition, so that an ignitable mixture can be formed in the area of the spark plug in a layered manner and the inflammation initiated by the spark plug immediately accounts for the remaining charging of the combustion chamber.

A reversing valve is provided for switching between the two different load-dependent injection times of the fuel injection device. Two inlet openings can be connected with the pump work space in an alternating manner. The outlet side has two outlet openings which are connected with the inlet opening depending on the position of the valve slide. The outlet openings lead to two different inner passage ducts of the rotating part of the distributor. The openings of the two passage ducts occupy different angular positions in the stationary part of the distributor so that the resulting two opening angle areas of the rotating part of the distributor lead or lag behind relative to one another with reference to the respective cylinder of the internal combustion engine.

The differently timed injection depending on the angular opening area is effected depending on which opening is connected with the inlet opening of the reversing valve by the reversing valve for the injection of fuel. Corresponding annular grooves assigned to the lines are provided for feeding the fuel from the reversing valve via lines into the through-ducts of the rotating part of the distributor. The fuel accordingly flows from the reversing valve, via the connected annular groove, into the corresponding through-duct and further, via its opening, into the respective injection line connected with a cylinder.

The method for load-dependent injection of fuel into the combustion chamber of the internal combustion engine achieved with the known fuel injection device has proven successful due to the savings on fuel and the reduced pollutant emissions resulting from this, but the construction of the fuel injection device is not optimal.

On the one hand, the known fuel injection device has the disadvantage of a complicated construction. In particular, it is costly to manufacture the numerous transitions for the fuel between the fixed part of the distributor and the rotating part of the distributor. For trouble-free operation, these fuel transitions which are constructed as annular grooves require exact manufacturing with low tolerances of the distributor parts and providing corresponding sealing means.

Moreover, the rotating part of the distributor has no homogeneous distribution of mass due to its internally extending through-ducts with the corresponding inlet and outlet openings at the surface of the rotating part of the distributor.

SUMMARY OF THE INVENTION

Accordingly, it is an object of the present invention to provide a fuel injection device which avoids the disadvantages of the prior art.

In keeping with these objects and with others which will become apparent hereinafter, one feature of the present invention resides, briefly stated, in a fuel injection device in which a reversing valve is arranged inside a rotating part of the distributor, preferably concentrically and its inlet opening is connected with a pump work space via a line which likewise extends exclusively inside the rotating part of the distributor.

When the fuel injection device is designed in accordance with the present invention, it has a simplified construction and does away with the aforementioned disadvantages.

The invention is based on the understanding that a number of fuel transitions (to be sealed) between the lines of the fixed part of the distributor and the assigned through-ducts arranged in the rotating part of the distributor can be avoided by placing the reversing valve in the rotating part of the distributor so that the cost of production is reduced. Moreover, the flow ratios of the delivered fuel within the lines and the through-ducts can accordingly be improved so that a more direct fuel delivery is made possible.

It is particularly advantageous if the reversing valve is arranged concentrically inside the rotating part of the distributor and its inlet opening is connected with the pump work space via a line which likewise extends exclusively inside the rotating part of the distributor. The rotating part of the distributor can accordingly be constructed so as to be uniformly concentric so that the bearing forces occurring during rotation are reduced relative to the known construction. Further, the through-ducts are connected directly with the reversing valve so that two transition ducts for the fuel between the fixed part and the rotating part of the distributor are dispensable.

The coaxial arrangement of the rotating part of the distributor is not changed when switching from partial load to full-load operation due to a displaceable supporting of the valve slide of the reversing valve in the axial direction of the rotating part of the distributor. An increase in the bearing forces during the switching process is accordingly avoided from the outset. Further, a more compact and lighter construction is made possible in that the rotating part of the distributor forms the wall guiding the valve slide.

The longitudinal axis of the reversing valve and/or the connection lines between the reversing valve and the pump work space coincide with the longitudinal axis of the rotating part of the distributor. The movements of the individual parts can accordingly be coordinated with one another advantageously. Moreover, an arrangement of the fuel lines which is favorable with respect to flow is made possible, i.e. fuel lines having short longitudinal lengths and the straightest possible construction with few changes of direction.

The valve slide of the reversing valve is supported in the rotating part of the distributor so as to be switchable in a simple manner by a hydraulic drive. The valve slide forms the work piston of the hydraulic drive. This work piston is acted upon at the front by the hydraulic fluid so as to ensure optimal force transmission. Further, the side wall of the valve slide forms a seal for the respective outlet opening of the reversing valve to be blocked. The valve slide is displaced between its two switching positions by the movement of the fluid without being influenced by the rotating movement of the rotating part of the distributor.

A coaxially extending hydraulic duct with radial connection ducts to an annular groove is provided as connection between the hydraulic drive and the stationary part of the distributor. During the displacing movements of the valve slide the hydraulic fluid passes via the annular groove, the connection duct to a front side of the valve slide, so that the valve slide is switchable during the rotation of the distributor rotor. Further, the hydraulic pressure for moving the valve slide can be built up by the hydraulic drive substantially without pressure loss by this construction and arrangement of the valve slide and the corresponding front side of the valve slide can be acted upon.

In an advantageous further development of the invention a valve, in particular a magnet valve, can be provided in the hydraulic drive for fixing the activation times of the valve slide. The magnet valve, and accordingly substantially the flow quantity and flow times of the hydraulic fluid during the switching process of the reversing valve, can be controlled in a simple manner by electrical signals.

The valve slide has an annular groove communicating with the connection line via pressure ducts to enable the fuel to be delivered in the most favorable manner possible with respect to flow. The fuel can be delivered to the additional openings of the through-ducts of the distributor via the annular groove.

The cost of production and machining of the stationary part of the distributor can be reduced in that the outlet openings of the inner through-ducts of the rotating part of the distributor are situated at the same height at its outer side with respect to the axial direction. Axial compensation is provided in the rotating part of the distributor by the displacement of the valve slide.

Further, the valve slide can be stabilized in a position which forms the initial position. In this position a spring acting in the axial direction and pretensioned in the direction of the pump work space contacts the front side of the valve slide located at a distance from the pump work space. The spring force presses the slide against a stop which is arranged corresponding to the initial position of the slide. In this way the valve slide is held in the initial position if there is a defect in the hydraulic line, i.e. preferably in the position for partial load operation. An uncontrolled movement of the slide is accordingly avoided during a possible defect of the hydraulic line and a controlled injection is also effected during failure or disturbances of the hydraulic drive.

According to an advantageous development of the invention, the rotating part of the distributor forms the work piston of the pump. The construction size of the fuel injection device is accordingly advantageously reduced and the possibility for developing the construction of the fuel injection device is broadened, particularly with respect to an optimal fuel delivery.

The annular groove for the hydraulic fluid or a facing opening provided at the opposite wall, respectively, extends in the axial direction in such a way as to allow the passage of hydraulic fluid regardless of the axial position of the rotating part of the distributor. The passage of hydraulic fluid during the rotating and lifting movements of the corresponding part of the distributor is accordingly fully guaranteed.

It has also proven particularly advantageous for defining the injection period for predetermined time periods of the pressure stroke and the injection quantity to provide a connection with a relief space via a relief line which can be opened in a time-dependent manner. The fuel line guiding the fuel into the pump work space is arranged coaxially relative to the axis of the rotating part of the distributor.

A check valve can be used for a simple feed line control. The check valve is provided in the fuel line guiding the fuel into the pump work space for closing the fuel line during the pressure stroke. In so doing a controllable fuel cut-off means is preferably connected parallel to the check valve. The fuel cut-off valve is located in the relief line.

Further, a pressure limiter is provided in the fuel line which prevents line pressures which possibly increase in a sudden manner by opening its valve.

The hydraulic drive is connected with the fuel line to make use of the pressure prevailing in the fuel line and accordingly to economize on a pressure source separate from the latter. The fuel forms the pressure medium and the pressure is produced by a delivery pump provided in the fuel line.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
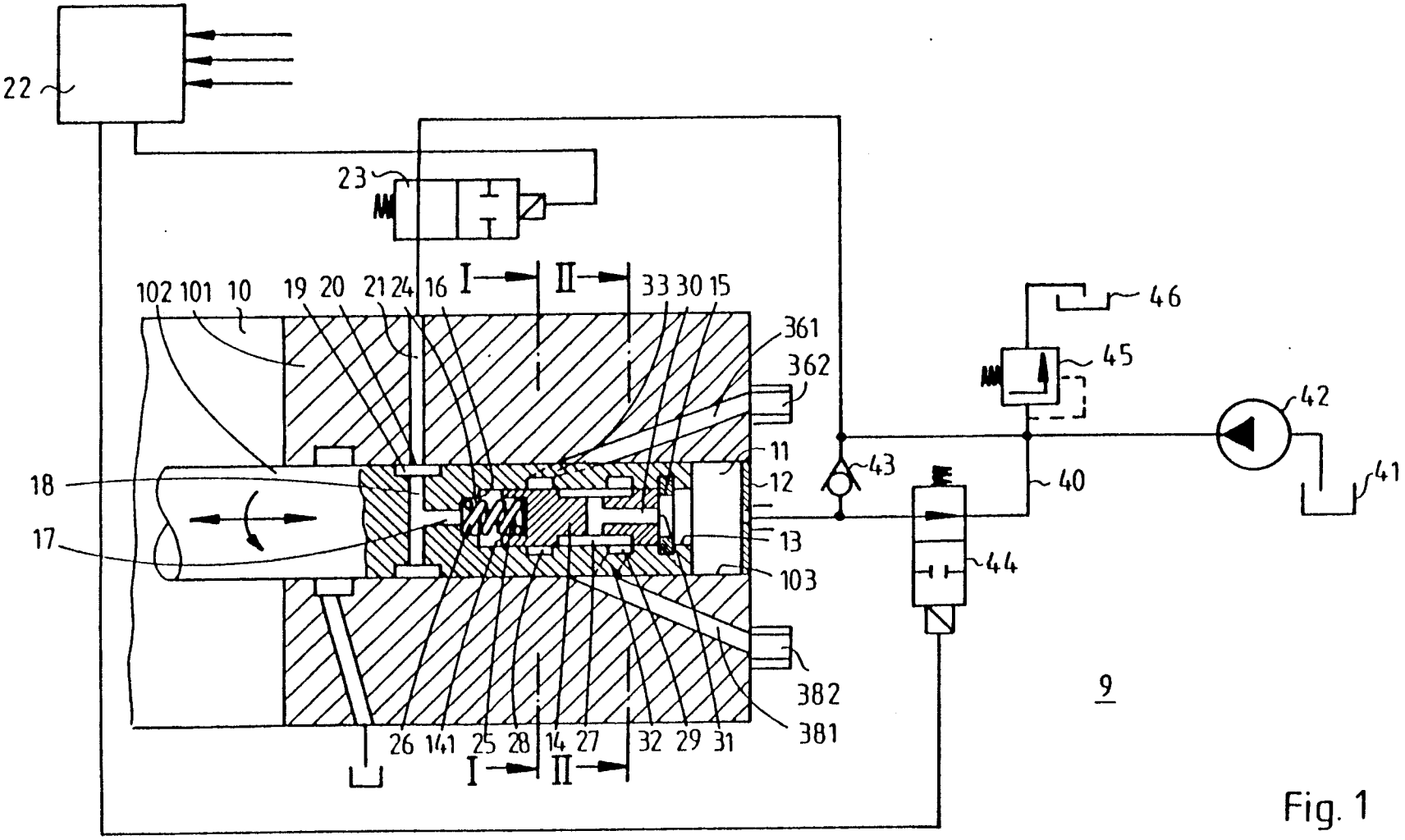
FIG. 1 shows a section through a fuel injection pump shown in a simplified manner.

An injection pump 9 for spark-ignition internal combustion engines having a distributor 10 with a stationary part 101 and a distributor rotor 102 is shown in the embodiment example.

The cylindrically constructed distributor rotor 102 of the distributor 10 is also constructed as a work piston of the injection pump 9 for pump movements and is connected with a rotating drive, not shown, which produces stroke movements by a control plate. The stationary part 101 of the distributor 10 is constructed as a cylinder so as to be adapted to the rotating part 102 of the distributor 10. The distributor rotor 102 is supported so as to be guided in the stationary part 101 of the distributor 10. A pump work space 11 substantially having the diameter of the distributor rotor 102 adjoins the free end of the distributor rotor 102. The pump work space 11 is expanded and reduced, respectively, by the stroke movements of the distributor rotor 102 and accordingly conveys the fuel located in the pump work space. The pump work space 11 is defined in the axial direction by a wall 12 and in the radial direction by the inner surface 103 of the stationary part 101 of the distributor 10 adapted to the distributor rotor 102.

A cylindrical recess 13 which extends up to the pump work space 11 and has a constant diameter along its axial extension is arranged coaxially relative to the axis of rotation within the distributor rotor 102. A valve slide 14 which is displaceable in the axial direction and adapted in the radial direction to the recess 13 is supported in the recess 13. Its axial displacing movement is defined in the direction of the pump work space 11 by a stop plate 15. The valve slide 14 which is displaceable in the recess acts as a reversing valve. The stop plate 15 is clamped in an adapted groove in the distributor rotor 102 in the recess 13. The front side 16 of the recess 13 defines the displacing movement in the opposite displacing direction of the valve slide 14 so that the latter 14 is supported so as to be displaceable from the front side 16 of the recess 13 at most until the stop plate 15.

The displacing movements of the valve slide 14 are effected via a hydraulic drive. For this purpose a hydraulic duct 17 leads through the center coaxially from the front side 16 of the recess 13 until two connection ducts 18 which extend radially with reference to the axis of the distributor rotor 102. These two radial connection ducts 18 end in an annular groove 19 integrally formed into the distributor rotor 102. The annular groove 19 corresponds with an opening 20 of a hydraulic line 21 and extends in the axial direction corresponding to the maximum stroke movements so that hydraulic fluid passes from the opening 20 into the annular groove 19 regardless of the position of the distributor rotor, and the valve slide 14 can accordingly always be moved by the hydraulic drive.

The adjacent side areas of the valve slide 14 close tightly with the recess 13 so that the assigned front side 141 of the valve slide 14 can be acted upon by hydraulic fluid without losses.

Because of the annular groove 19 extending in the axial direction the hydraulic fluid passes from the line 21 via the annular groove 19 into the radial connection duct 18 and into the hydraulic duct 17 at the front side 141 of the valve slide 14 regardless of the axial position of the distributor rotor 102. This valve slide 14 acts as work piston of the hydraulic drive.

A magnet valve 23 connected with a control device 22 is arranged in the hydraulic line 21 for fixing the activating times of the valve slide. The magnet valve 23 opens as controlled by the control device 22 so that the valve slide is pressed into its left- or right-hand position as a result of the pressure ratios in the pump work space 11 and the pressure conditions due to the hydraulic fluid of the hydraulic drive.

A cylindrical, coaxially arranged cut out portion 24 is provided in the front side 16 of the recess 13 and a corresponding additional cut out portion 25 is provided in the front side 141 of the valve slide 14. The two cut out portions 24 and 25 are connected with one another via a pretensioned spring 26 which presses the valve slide 14 in the direction of the pump work space 11. In the event of a possible defect in the hydraulic line, the valve slide 14 is accordingly pressed against the stop plate 15, the position of the valve slide during partial load operation of the internal combustion engine, by the pretensioned spring 26.

An outwardly facing annular groove 27 is formed into the valve slide 14 and two inwardly facing annular grooves 28 and 29 which are arranged so as to be offset in the axial direction corresponding to the displacing movement of the valve slide 14 are formed into the distributor rotor 102.

A coaxially extending connection duct 30 proceeds from the annular groove 27, first in the radial direction toward the center of the valve slide 14 and then in the axial direction toward the pump work space 11, and enables a flow of fuel from the pump work space 11 into the inlet opening 31 of the connection duct 30 and into the annular groove 27.

A passage duct 32 and 33 leads from the annular grooves 28 and 29 at the outer surface of the distributor rotor 102. The outlet openings 34 and 35 of the passage ducts 32 and 33 are arranged at the same height in the axial direction. Inlet openings 36 to 39 of injection lines 361 to 391 are arranged in the stationary part 101 of the distributor 10 at a height corresponding to the outlet openings 34 and 35 of the passage ducts 32 and 33. The passage ducts 32 and 33 extend diagonally in the distributor rotor 102 to compensate for the axial offsetting of their assigned annular grooves 28 and 29. The inlet openings 36 to 39 form an angle of 90° adjacent to one another. The injection lines 361 to 391 are connected with injection nozzles 362 to 392 which introduce the fuel into the cylinder of the internal combustion engine. The outlet openings 34 and 35 occupy different angular positions at the outer surface of the distributor rotor 102 so that the opening angle areas of the distributor which are thus produced lead or lag behind relative to one another with reference to the respective cylinder of the internal combustion engine, not shown. The reference numbers of the aforementioned openings are omitted from these figures for reasons of simplicity. However, these openings can be discerned from FIGS. *2a* and *2b*.

The pump work space 11 can be connected via the annular groove 27 and the annular groove 28 and 29, respectively, with the passage duct 32 and 33, respectively, as a result of the displacement of the valve slide 14 in one of the two stop positions. The fuel introduced into the pump work space 11 can accordingly be delivered via the passage duct 32 and 33 into the injection lines 361 to 391 and accordingly, in a corresponding manner, into the cylinders of the internal combustion engine.

The fuel passes into the pump work space 11 via a fuel line 40 arranged coaxially relative to the rotating axis of the distributor rotor 102. The fuel line 40 guides the fuel into the pump work space 11 from an electric fuel pump 42, which acts upon the fuel with pressure and conveys it from a supply tank 41, via a check valve 43 which is provided for closing the fuel line 40 during the pressure stroke. Another magnet valve 44 which is connected with the control device 22 is connected parallel to the check valve 43. The magnet valve 44 opens for predetermined time periods of the pressure stroke as a result of signals from the control device 22. The injection period and the injection amount are controlled via this magnet valve 44, since fuel flows from the pump work space 11 through the magnet valve 44 when the magnet valve 44 opens during the pressure stroke. The start of delivery, the delivery quantity and the delivery duration can be controlled with the opening of the magnet valve 44 so that the fuel is injected into the cylinder of the internal combustion engine by the distributor rotor 102 in a correspondingly smaller quantity or for a shorter time period, respectively.

A pressure limiter 45 is connected upstream of the check valve 43 and the magnet valve 44 for limiting the pressure in the fuel line 40 and to keep the pressure in the fuel line 40 constant, so that the pressure limiter 45 opens when a predetermined pressure value is exceeded and fuel can escape into a collecting tank 46.

The hydraulic drive is connected with the fuel line 40 and the fuel forms the pressure medium, i.e. the hydraulic fluid, and the pressure in the hydraulic fluid is produced by the electric fuel pump 42.

Depending on the type of operation of the internal combustion engine, i.e. full-load or partial load operation, the injection is effected in the suction stroke or in the compression stroke of the piston of the internal combustion engine via the outlet openings 34 and 35 of the passage duct 32 and 33 which lead or lag behind relative to one another. The injection times are determined substantially by the different times at which the outlet openings 34 and 35 pass the inlet openings 36 to 39. However, it is still possible to influence the injection process via the magnet valve 44.

In full-load operation, i.e. injection in the suction stroke, the valve slide 14 is in its left-hand position so that the fuel passes from the pump work space 11 via the connection duct 30 into the passage duct 33 and then into the corresponding cylinder.

The magnet valve 23 remains open at first during the delivery stroke of the distributor rotor 102. After the magnet valve 44 is closed, the pressure build-up is effected in the pump work space 11 and the valve slide 14 moves toward its left-hand stop, the front side 16 of the recess 13. Before the magnet valve 44 is opened, the magnet valve 23 closes. The control slide accordingly remains in its left-hand position. The magnet valve 23 is closed again briefly only at the beginning of the pressure build-up in the next stroke cycle of the distributor rotor. The process is then repeated periodically.

In partial load operation, i.e. injection in the compression stroke of the piston of the internal combustion engine, the valve slide 14 is in the right-hand position so that the fuel passes via the connection duct 30 into the passage duct 32 and accordingly into the assigned cylinders of the internal combustion engine.

The magnet valve 23 remains closed during the delivery stroke of the distributor rotor 102 so that the valve slide 14 cannot be deflected toward the left-hand side, since the hydraulic pressure continues to act on the valve slide 14. The magnet valve 23 is opened briefly during the suction stroke of the distributor rotor 102 to correct a misadjustment which can occur because of leakage at the valve slide 14. The forces acting on the valve slide 14, spring force, inertia force and pressure differential forces between the left- and right-hand front side, provide for the contact pressure against the stop plate 15.

If a defined initial position is to be dispensed with the positioning of the valve slide 14 can also be effected via the described wiring of the magnet valve 23.

A spark-ignition internal combustion engine can be operated with gasoline with the fuel injection device 9 according to the invention in combination with the advantages resulting in an automatic-ignition internal combustion engine from feeding the combustion air into the combustion chambers with low losses and without throttling.

The embodiment example is directed to a fuel supply of a four-cylinder internal combustion engine. Of course, a different number of cylinders can also be provided with such a correspondingly modified fuel injection pump. The outlet opening 34 leads the outlet opening 35 by the angular distance between the successive injection lines 361 to 391.

Figure 2A:
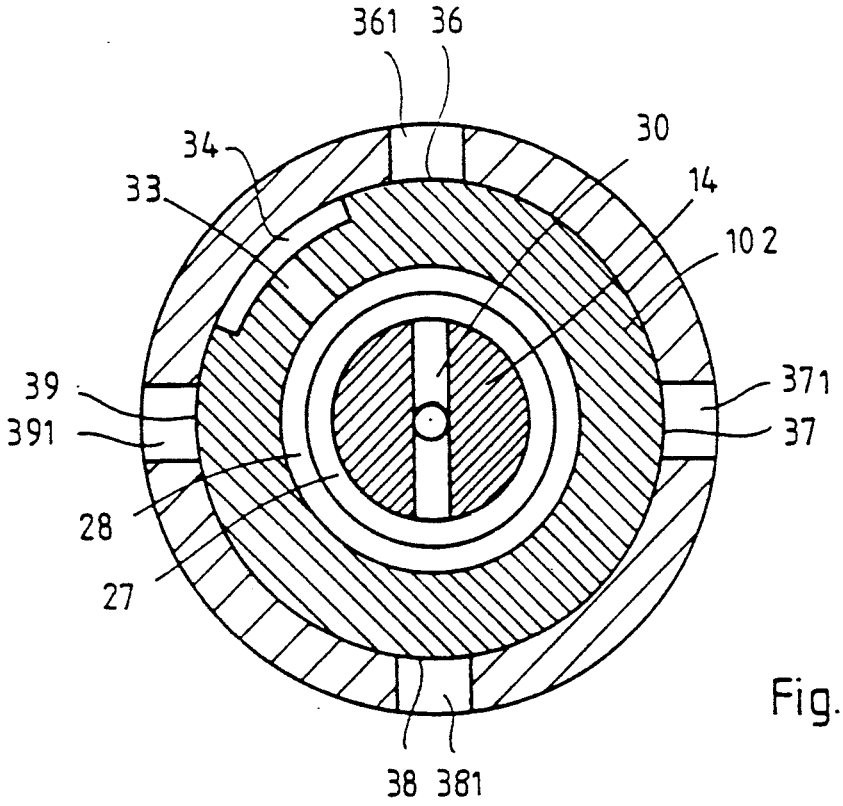
FIGS. 2*a* and 2*b* each show a section through the distributor of the fuel injection pump in different switching positions.
Figure 2O:
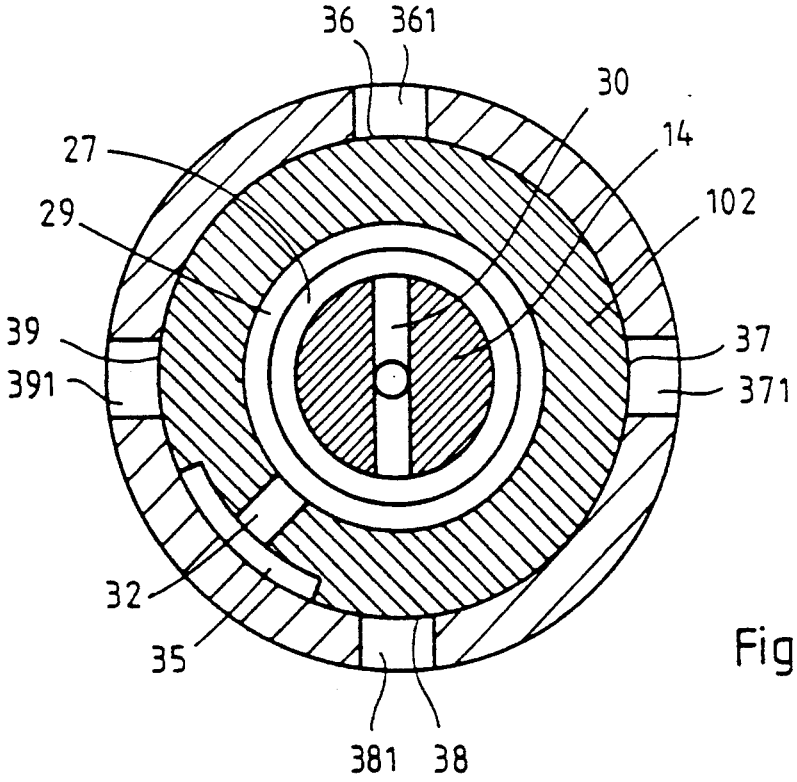

A cross section I—I and II—II from FIG. 1 through the distributor 10 is shown in FIGS. 2*a* and 2*b*. The valve slide 14 occupies the left-hand position at times, FIG. 2*a*, and the right-hand position at times, FIG. 2*b*, from which the manner of operation of the distributor in full- and part-load operation can be seen.

In full-load operation the valve slide 14 is in the left-hand position. The fuel from the pump work space 11 passes from the connection duct 30 into the annular groove 27 of the valve slide 14, into the annular groove 28 of the distributor rotor 102 via the passage duct 33, its outlet opening 34, via the inlet openings 36 to 39 into the injection lines 361 to 391 and into the respective cylinders.

During partial load operation on the other hand the valve slide 14 is located in the right-hand position and the fuel passes from the annular groove 27 of the valve slide 14 into the annular groove 29 of the distributor rotor 102, the passage duct 32, its outlet opening 35 via the inlet openings 36 to 39 into the injection lines 361 to 391 into the connected cylinders.

The outlet openings 34 and 35 are arranged at an angle of 90° relative to one another so that the injection time is effected so as to be offset in time by a 180° crankshaft angle.

The injection times for the cylinders 1 to 4 are shown as a function of the angle of rotation of the crankshaft in FIGS. 3*a* to 3*d* in four diagrams. FIG. 3*e* shows a schematic cross section through the distributor 10 with its passage ducts 32 and 33 and the connected cylinders 1 to 4 for a better understanding of FIGS. 3*a* to 3*d*.

Figure 3A:
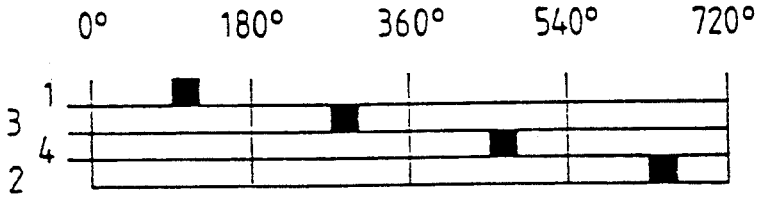
FIGS. 3*a* to 3*e* each show a diagram of an injection sequence as a function of the load of the internal combustion engine and corresponding to the possible switching processes with a cross section of the distributor shown in a schematic manner.

The injection sequence during partial load operation of the internal combustion engine, i.e. injection during the compression stroke, is shown schematically in FIG. 3*a* in the form of black boxes. The ignition time and top dead center is at 180° for the first cylinder, 360° for the third cylinder, 540° for the fourth cylinder, and 0° or 720° for the second cylinder.

Figure 3B:
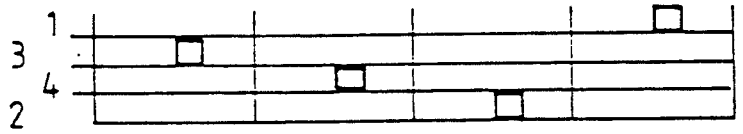

In FIG. 3*b* the injection cycle for full-load operation, injection in the suction stroke, is shown in the form of white boxes. The change of the cylinder charge and the top dead center are at 180° for the fourth cylinder, at 360° for the second cylinder, at 540° for the first cylinder, and at 720° for the third cylinder.

A particular control state resulting during the switching over from suction to compression stroke injection and vice versa is to be explained in more detail in the following.

Figure 3C:
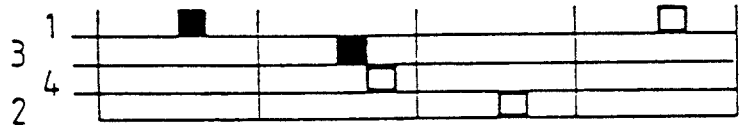

FIG. 3*c* shows the control during the switching from compression to suction stroke injection. Injection into the first cylinder is first effected while still in the compression stroke. In a sudden switching to suction stroke injection no work stroke would be effected now in the next cycle in cylinder 3 since the entire quantity is injected into cylinder 4. To prevent this misfiring, injection is now first effected again in cylinder 3 in the compression stroke and subsequently in the same cycle in cylinder 4 by switching over the valve slide 14. The pump feed cam is sufficient for this purpose, since injection is only effected in the compression stroke in the lower partial load, that is, in small injection quantities.

Figure 3D:
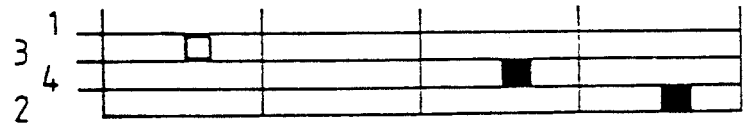
Figure 3E:
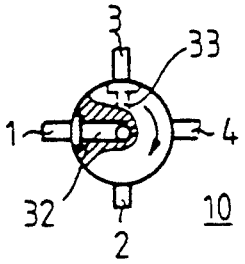

FIG. 3*d* shows the opposite case, switching over from suction to compression stroke injection. Injection would be effected in cylinder 3 still in the suction stroke. This quantity is ignited in the next cycle, i.e. the magnet valve 44 may not be closed now since otherwise an additional quantity would be injected. The switching of the valve slide 14 is then effected, so that injection is effected in the compression stroke of the fourth cylinder.

Figure 4:
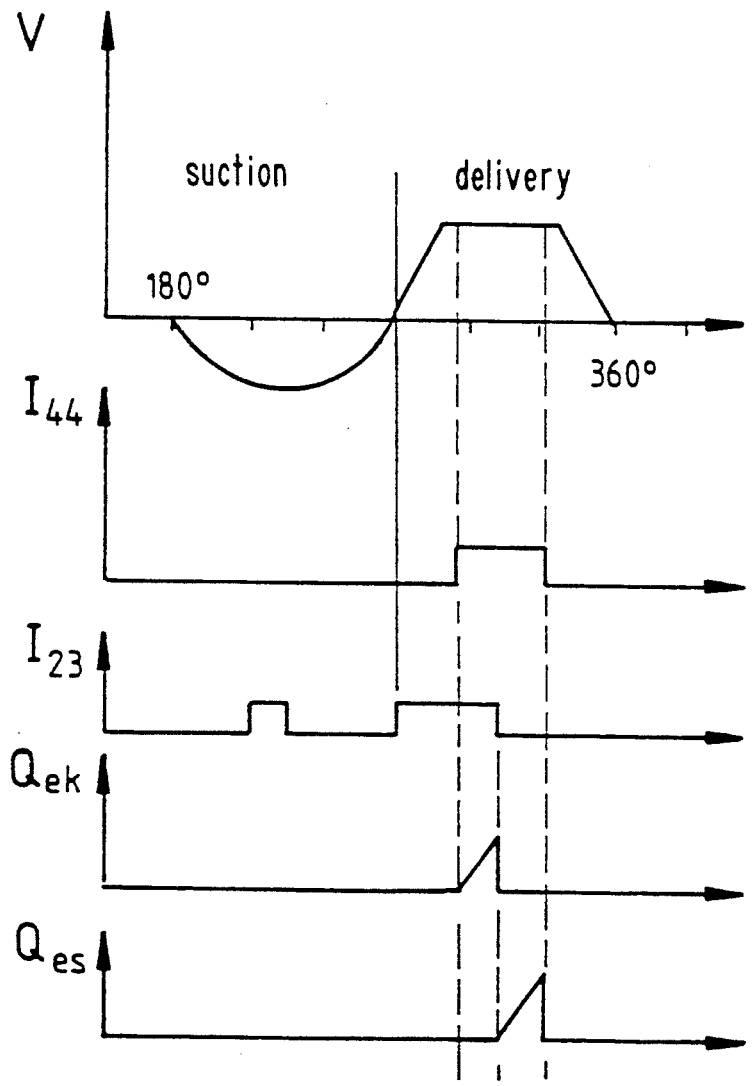
FIG. 4 shows five time-dependency diagrams with different dependencies in a switching process of the reversing valve.

The control pulses I 23 and I 44 of the magnet valves 23 and 44, the injection quantity in the compression or suction stroke Qek or Qes, respectively, and the speed of the stroke movement of the distributor rotor 102 as a function of the crankshaft angle of rotation during the switching process from the compression stroke to the suction stroke according to FIG. 3*c* is shown in the diagrams of FIG. 4.

The invention is not limited in terms of construction to the preferred embodiment example described above. Rather, a number of variants are conceivable which also make use of the shown solution in constructions of fundamentally different kinds.

It will be understood that each of the elements described above, or two or more together, may also find a useful application in other types of constructions differing from the types described above.

While the invention has been illustrated and described as embodied in a fuel injection device for spark-ignition internal combustion engines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters patent is set forth in the appended claims.

1. A fuel injection device for spark-ignition internal combustion engines, comprising a pump having a pump work space; a distributor having a rotating part which alternately connects a feed line of a pump with injection lines leading to individual cylinders of the internal combustion engine as a function of an angle of rotation; and a reversing valve actuated as a function of a load and a speed of the internal combustion engine, said reversing valve being arranged inside said rotating part of said distributor and having an inlet opening connected with said pump work space of said pump via a connection line which also extends exclusively inside said rotating part of said distributor, said reversing valve having a valve slide and two outlet openings, said valve slide forming a work piston of a hydraulic drive, said work piston being acted upon by a hydraulic fluid at its front side and forming a seal for the respective outlet opening of said reversing valve to be blocked with its side wall.

2. A fuel injection device for spark-ignition internal combustion engines, comprising a pump having a pump work space; a distributor having a rotating part which alternately connects a feed line of a pump with injection lines leading to individual cylinders of the internal combustion engine as a function of an angle of rotation; and a reversing valve actuated as a function of a load and a speed of the internal combustion engine, said reversing valve being arranged inside said rotating part of said distributor and having an inlet opening connected with said pump work space of said pump via a connection line which also extends exclusively inside said rotating part of said distributor, said rotating part of said distributor forming a work piston of said pump.

3. A fuel injection device as defined in claim 2, wherein said reversing valve is arranged inside said rotating part concentrically relative to said rotating part.

4. A fuel injection device as defined in claim 2, wherein said reversing valve occupies two positions and has a valve slide and two outlet openings which are connected with said inlet opening as a function of a position of said valve slide, said rotating part having passage ducts connected with said outlet openings and also being provided with openings which occupy a different angular position so that two opening angle areas of said distributor are thus produced and lead or lag behind relative to one another with reference to a respective cylinder of the internal combustion engine.

5. A fuel injection device as defined in claim 2, wherein said reversing valve has a valve slide which is displaceable in an axial direction of said rotating part of said distributor, said rotating part of said distributor forming wall which guides said valve slide.

6. A fuel injection device as defined in claim 2, wherein said rotating part of said distributor has a longitudinal axis, said reversing valve and said connection line also each having a longitudinal axis, said longitudinal axis of at least one of said reversing valve and said connection line coincides with said longitudinal axis of said rotating part of said distributor.

7. A fuel injection device as defined in claim 2, wherein said longitudinal axis of said reversing valve and said connection line coincide with said longitudinal axis of said rotating part of said distributor.

8. A fuel injection device as defined in claim 2, wherein said reversing valve has a valve slide and two outlet openings, said valve slide forming a work piston of a hydraulic drive, said work piston being acted upon by a hydraulic fluid at its front side and forming a seal for the respective outlet opening of said reversing valve to be blocked with its side wall.

9. A fuel injection device as defined in claim 8, wherein said distributor has a stationary part; and further comprising a connection between said hydraulic drive and said stationary part of said distributor, said connection including an annular groove, a coaxially extending hydraulic duct and radial connection ducts extending from said hydraulic duct to said annular groove so that a hydraulic fluid passes with said annular groove and said connection duct to said front side of said valve slide during its displacement movements.

10. A fuel injection device as defined in claim 8; and further comprising a valve provided in said hydraulic drive for fixing activating times of said valve slot.

11. A fuel injection device as defined in claim 9, wherein said rotating part of said distributor has inner passage ducts with additional openings, said valve slide having an annular slide groove which is connected with said connection line so that the fuel can be delivered to said additional openings of said passage ducts via said slider groove.

12. A fuel injection device as defined in claim 11, wherein said inner passage ducts of said rotating part of said distributor have outlet openings which are located at a same height at its outside with respect to an axial direction of said rotating part.

13. A fuel injection device as defined in claim 2, wherein said reversing valve has a vale slide with a front side situated at a distance from said pump work space; and further comprising a spring acting in an axial direction and pretensioned in direction of said pump work space so as to contact said front side of said valve slide.

14. A fuel injection device as defined in claim 2, wherein said rotating part of said distributor forms a work piston of said pump.

15. A fuel injection device as defined in claim 9, wherein said annular groove extends in an axial direction so a to allow passage of hydraulic fluid regardless of an axial position of said rotating part of the distributor.

16. A fuel injection device as defined in claim 9; and further comprising a wall located to said annular groove sand provided with a facing opening, said facing opening extending in an axial direction so as to allow passage of hydraulic fluid regardless of an axial position of said rotating part of said distributor.

17. A fuel injection device as defined in claim 2; and further comprising means for connecting the device with a relief space and including a relief line which can be opened in a time-dependent manner for limiting an injection period for determined time periods of a pressure stroke.

18. A fuel injection device as defined in claim 2, wherein said rotating part of said distributor has an axis; and further comprising a fuel line guiding a fuel into said pump work space and arranged coaxially relative to said axis of said rotating part.

19. A fuel injection device as defined in claim 2; and further comprising a fuel line guiding a fuel into said pump work space; and a check valve for closing said fuel line during a pressure stroke and provided in said fuel line.

20. A fuel injection device as defined in claim 19; and further comprising controllable fuel cut-off means connected parallel to said check valve.

21. A fuel injection device as defined in claim 2; and further comprising a fuel line guiding a fuel into said pump work space; and a pressure limiter provided in said fuel line.

22. A fuel injection device as defined in claim 2; and further comprising a fuel line guiding a fuel into said pump work space; a hydraulic drive connected with said fuel line so that the fuel forms a pressure medium; and a feed pump provided in said fuel line and producing a pressure of the fuel.

23. A fuel injection device as defined in claim 1, wherein said reversing valve is arranged inside said rotating part concentrically relative to said rotating part.

24. A fuel injection device as defined in claim 1, wherein said reversing valve occupies two positions, said rotating part having passage ducts connected with said outlet openings and also being provided with openings which occupy a different angular position so that two opening angle areas of said distributor are thus produced and lead or lag behind relative to one another with reference to a respective cylinder of the internal combustion engine.

25. A fuel injection device as defined in claim 1, wherein said valve slide is displaceable in an axial direction of said rotating part of said distributor, said rotating part of said distributor forming a wall which guides said valve slide.

26. A fuel injection device as defined in claim 1, wherein said rotating part of said distributor has a longitudinal axis, said reversing valve and said connection line also each having a longitudinal axis, said longitudinal axis of at least one of said reversing valve and said connection line coincides with said longitudinal axis of said rotating part of said distributor.

27. A fuel injection device as defined in claim 26, wherein said said longitudinal axis of said reversing valve and said connection line coincide with said longitudinal axis of said rotating part of said distributor.

28. A fuel injection device as defined in claim 1, wherein said distributor has a stationary part; and further comprising a connection between said hydraulic drive and said stationary part of said distributor, said connection including an annular groove, a coaxially extending hydraulic duct and radial connection ducts extending from said hydraulic duct to said annular groove so that a hydraulic fluid passes via said annular groove and said connection duct to said front side of said valve slide during its displacement movements.

29. A fuel injection device as defined in claim 1; and further comprising a valve provided in said hydraulic drive for fixing activating times of said valve slot.

30. A fuel injection device as defined in claim 29, wherein said valve is formed as a magnet valve.

31. A fuel injection device as defined in claim 28, wherein said rotating part of said distributor has inner passage ducts with additional openings, said valve slide having an annular slide groove which is connected with said connection line so that the fuel can be delivered to said additional opening of said passage ducts via said slider groove.

32. A fuel injection device as defined in claim 31, wherein said inner passage ducts of said rotating part of said distributor have outlet openings which are located at a same height at its outside with respect to an axial direction of said rotating part.

33. A fuel injection device as defined in claim 1, wherein said valve slide has a front side situated at a distance from said pump work space; and further comprising a spring acting in an axial direction and pretensioned in direction of said pump work space so as to contact said front side of said valve slide.

34. A fuel injection device as defined in claim 1, wherein said rotating part of said distributor forms a work piston of said pump.

35. A fuel injection device as defined in claim 28, wherein said annular groove extends in an axial direction so as to allow passage of hydraulic fluid regardless of an axial position of said rotating part of the distributor.

36. A fuel injection device as defined in claim 28; and further comprising a wall located to said annular groove and provided with a facing opening, said facing opening extending in an axial direction so as to allow passage of hydraulic fluid regardless of an axial position of said rotating part of said distributor.

37. A fuel injection device as defined in claim 1; and further comprising means for connecting the device with a relief space and including a relief line which can be opened in a time-dependent manner for limiting an injection period for predetermined time periods of a pressure stroke.

38. A fuel injection device as defined in claim 1, wherein said rotating part of said distributor has an axis; and further comprising a fuel line guiding a fuel into said pump work space and arranged coaxially relative to said axis of said rotating part.

39. A fuel injection device as defined in claim 1; and further comprising a fuel line guiding a fuel into said pump work space; and a check valve for closing said fuel line during a pressure stroke and provided in said fuel line.

40. A fuel injection device as defined in claim 39; and further comprising controllable fuel cut-off means connected parallel to said check valve.

41. A fuel injection device as defined in claim 1; and further comprising a fuel line guiding a fuel into said pump work space; and a pressure limiter provided in said fuel line.

42. A fuel injection device as defined in claim 1; and further comprising a fuel line guiding a fuel into said pump work space; a hydraulic drive connected with said fuel line so that the fuel forms a pressure medium; and a feed pump provided in said fuel line and producing a pressure of the fuel.

* * * * *